United States Patent [19]

Geisinger

[11] 4,305,478

[45] Dec. 15, 1981

[54] ANCHORING AND RESCUE APPARATUS

[76] Inventor: Glen W. Geisinger, P.O. Box 274, Saratoga, Calif. 95070

[21] Appl. No.: 166,044

[22] Filed: Jul. 7, 1980

[51] Int. Cl.[3] ..... A62B 35/00

[52] U.S. Cl. ..... 182/3

[58] Field of Search ..... 182/3-9, 182/142, 128, 129, 82

[56] References Cited

U.S. PATENT DOCUMENTS

| | | | |
|---|---|---|---|
| 1,897,810 | 2/1933 | Mallory | 182/3 |
| 1,899,162 | 2/1933 | Lackner | 182/3 |
| 2,684,875 | 7/1954 | Kircher | 182/3 |
| 2,725,853 | 12/1955 | Nordheim | 182/3 |
| 2,997,932 | 8/1961 | Taylor | 94/34 |
| 3,120,290 | 2/1964 | Kamrath | 182/169 |
| 3,137,487 | 6/1964 | Lesser | 182/3 |
| 3,309,803 | 3/1967 | Wilson | 38/102.2 |
| 3,712,009 | 1/1973 | Campagna | 52/20 |
| 3,876,036 | 4/1975 | Sweet | 182/5 |
| 3,891,337 | 6/1975 | McCoy | 404/26 |
| 4,171,032 | 10/1979 | Woolslayer | 182/3 |
| 4,249,713 | 2/1971 | Glynn | 182/3 |

OTHER PUBLICATIONS

The Universal Tripod, Butco date 12/17/79.

*Primary Examiner*—Reinaldo P. Machado
*Attorney, Agent, or Firm*—Phillips, Moore, Weissenberger, Lempio & Majestic

[57] ABSTRACT

Prior apparatus for anchoring a person working within an enclosed chamber such as a manhole (10) is relatively bulky. Herein, a member (18) sits upon a periphery (14) of an overhead opening (18) to the chamber (10). A support structure (26) is attached to the member (18). An anchoring structure (32) serves for normally preventing a line (17) which is attached to a person in the chamber (10) from playing out downwardly into the chamber (10) and for allowing the line (17) to be freely drawn upwardly out of the chamber (10) with the person attached thereto. The anchoring structure (32) is mounted to the member (18). The overall apparatus (16) is relatively small and light in weight, can be used on sloped ground and allows maximal use of a rescuer's leg muscles in drawing a person out of the manhole (10).

9 Claims, 3 Drawing Figures

ANCHORING AND RESCUE APPARATUS

DESCRIPTION

Technical Field

This invention relates generally to an apparatus for anchoring a line attached to a person who is in a confined space having an overhead opening such as a below ground chamber, a tank car, a vault, or the like, and, more particularly, for anchoring a line attached to a person who is in a manhole.

Background Art

Inside of a manhole water may be flowing through pipes which are large enough to accept a persons body. The water in the pipes may be flowing at relatively high speeds, certainly high enough speeds to carry a person into the pipe flow and away from the manhole. Yet, the person working in the manhole must have sufficient mobility so as to perform necessary maintenance and repair tasks and the like.

To protect a person working in a manhole, it is known, and required by various safety codes, to attach one end of a line to the person and to attach the other end of the line to some stationary object. A presently used apparatus for accomplishing this is a tripod of heavy construction and having legs which fit on the ground well outside of the periphery of the opening to the manhole. A winch is attached to one of the legs of the tripod and a pulley is centered at its apex. The line which is attached to the person working in the manhole goes over the pulley and is attached to the winch. The person who is to work in the manhole is then lowered by operation of the winch. This apparatus is sold under the trademark "The Universal Tripod" by Butco.

Such tripod devices as have just been described are relatively large and heavy. Thus, they are inconvenient to transfer from one worksite to another. Also, the three legs of the tripod must sit upon generally level ground or the stability of the entire apparatus is reduced. Even when the legs are made telescoping to allow for some variation in terrain, the stability of the apparatus is not ideal. Thus, when the opening to the manhole is on a slope, such tripod type devices have, at best, limited usefulness. And, the tripods are relatively expensive, particularly if they have telescoping legs. Also, it requires a good deal of time to set up such tripod type devices. As a result, some workmen ignore safety regulations and work without a line. This has led to a number of deaths. Further, a rescuer primarily uses his arm and upper back muscles, rather than his stronger leg muscles, to withdraw a person from the underground chamber. And, a single rescuer can draw a person up from below ground to the opening of the chamber.

The present invention is directed to overcoming one or more of the problems as set forth above.

Disclosure of the Invention

In one aspect of the present invention an improved safety apparatus is set out for anchoring a line attached to a person working in an enclosed chamber and for withdrawing the line and recovering the person from the chamber. The improved apparatus comprises a generally planar member having a top portion and a bottom portion, the member being adapted to surroundingly engage a substantial portion of a periphery of an overhead opening of the chamber. A support structure is attached to the member. Anchoring means are provided for normally preventing a line attached to the person in the chamber from playing out downwardly into the chamber and for allowing the line to be freely drawn upwardly out of the chamber. Means are provided for mounting the anchoring means to the member.

An improved safety apparatus as set out above has the advantage of being relatively small and light in weight, and, thus, being easily transportable from one manhole to another. The apparatus can be very quickly set up, whereby workmen are willing to use it. Also, such an apparatus can be readily used with manholes that are located on a slope. The particular apparatus of the present invention is also structured so that a rescuer can relatively easily withdraw a line and recover a person attached to a line utilizing the rescuer's relatively strong leg muscles. Winches, block and tackle devices, and the like, may be used with the apparatus, if desired. When a winch is used with the apparatus, it can also be used to lower a workman into the chamber, thus preventing ladder accidents.

BEST MODE FOR CARRYING OUT THE INVENTION

While the invention is explained in conjunction with a below ground chamber, this is done for convenience only and the invention is not so limited. Indeed, the invention is useful with any enclosed chamber having an overhead opening.

Figure 1:
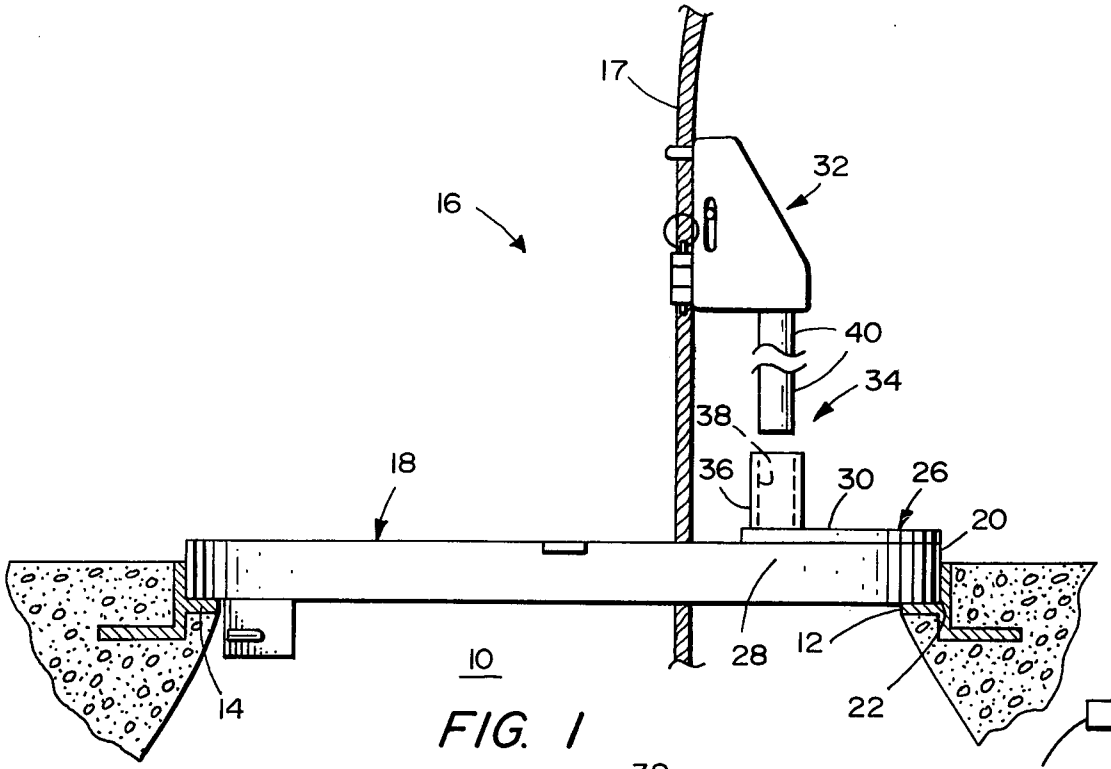
FIG. 1 illustrates, in side view, partially in section, one embodiment of the present invention in position at the entrance to a manhole.

FIG. 1 shows the top portion of a below ground chamber such as a manhole 10 which has a ground level opening 12. A cover (not illustrated) normally sits upon an infacing flange 14 which extends around the periphery of the opening 12.

Figure 2:
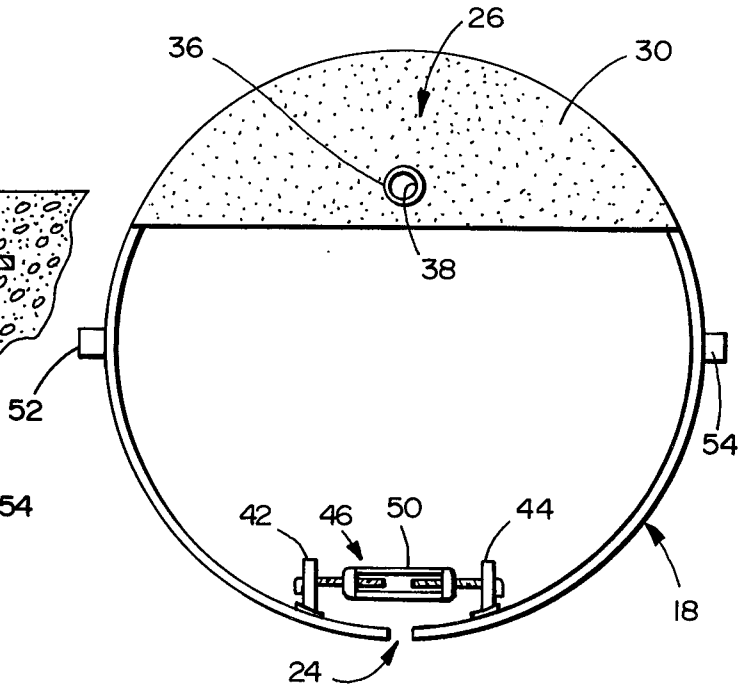
FIG. 2 illustrates, in top view, a portion of the embodiment of FIG. 1.
Figure 3:
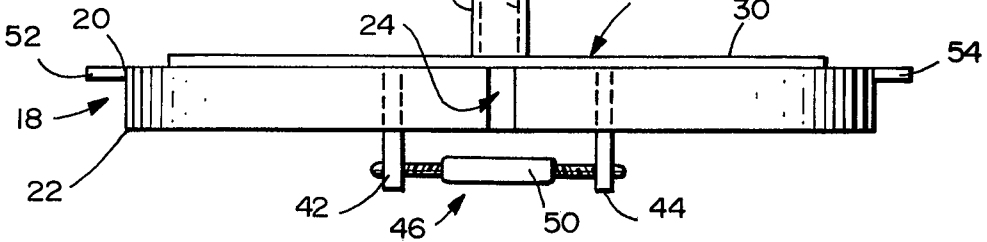
FIG. 3 illustrates a view taken along the line III—III of FIG. 2.

In accordance with the present invention, an improved safety apparatus 16 is provided which serves for anchoring a line 17 to a person and for withdrawing the line 17 and recovering the person from the chamber 10. The apparatus 16 includes a generally ring shaped member 18, shown in each of FIGS. 1, 2 and 3. The generally ring shaped member 18 has a top portion 20 and a bottom portion 22. The bottom portion 22 of the member 18 is adapted to sit upon a periphery of the opening 12, in the embodiment illustrated upon the flange 14. As will be most apparent from FIGS. 2 and 3, the member 18 is preferably an incomplete ring having a gap 24 therein. This allows for some slight adjustment of the size of the member 18 so that it will fit in slightly differing sized manhole openings.

A platform 26 is attached to and generally across a part 28 of the member 18, and usually across the top portion 20 thereof. The platform 26 is generally attached opposite the gap 24. The platform 26 preferably has a roughened upper surface 30 so as to provide slip free footing when such is needed for rescuing a person attached to the line 17. It is also possible (not illustrated) to attach the platform 26 to extend laterally outwardly from the member 18 to sit on the ground surrounding the opening 12. It will be noted that the platform 26 is located in such a position that a man pulling up on the line 17 will be able to utilize his relatively strong leg muscles to lift someone out of the manhole 10.

Anchoring means 32 are provided for normally preventing the line 17 from playing out downwardly into the chamber 10 and for allowing the line 17 to be freely drawn upwardly out of the chamber 10. While a number of anchoring means are known which will accomplish this task, one particularly desirable anchoring means is that taught in U.S. Pat. No. 3,876,036, issued Apr. 8, 1975 to Robert E. Sweet. This device allows free drawing of the line 17 upwardly, but locks the line 17 against downward movement therethrough. When used as the anchoring means 32 of the present invention, the device in the aforementioned U.S. Pat. No. 3,876,036 is utilized upside down from the way that it is taught to be utilized in that patent.

Also in accordance with the present invention, means 34 are provided for mounting the anchoring means 32 to the member 18, generally to extend generally above the platform 26. The mounting means 34 of preference includes a structure 36 attached to a respective one of the platform 26 and the anchoring means 32, which structure 36 defines a generally vertically extending well 38. In the preferred embodiment illustrated, the structure 36 is attached to the platform 26. The mounting means 34, in the preferred embodiment, also generally includes a post 40 which extends from a respective other of the platform 26 and the anchoring means 32. In the particular embodiment illustrated, the post 40 extends from the anchoring means 32. The post 40 is adapted to generally fill the well 38 in the structure 36. It will be clear that a man standing on the platform 26 and pulling upwardly upon the line 17 is located so that he is pulling relatively directly upwardly upon the line 17. By wrapping the line 17 about his lower back or buttocks when he is crouched on the platform 26, and then extending his legs, he can apply the maximum strength of his leg muscles to lift a person out of the manhole 10. In order to provide maximum stability to the apparatus 16, the gap 24 is generally on a diameter of the member 18 which includes the respective one of the structure 36 and the post 40, in the embodiment illustrated the structure 36, and is removed generally maximally therefrom.

An apparatus 16 as described above is extremely stable and performs its task fully adequately. However, in order to still more stably support the member 18 it is possible to add certain structures thereto as will be described in following. First, a pair of downwardly extending rods 42,44 may be attached to the member 18, one generally adjacent each end of the gap 24. These rods then extend downwardly into the manhole 10 on the inside of, and in contact with, the flange 14. If desired, a construction 46, such as the turnbuckle illustrated, may be attached between the rods 42 and 44, as illustrated, or generally in the gap 24 in the ring 18, if desired. When the construction 46 is a turnbuckle, means 48 are provided for adjusting its length, such means comprising, for example, a conventional ring 50 tapped at both ends with oppositely threaded holes.

For still more safety, a pair of ears 52 and 54 can be attached to the member 18, and generally to the top portion 20 thereof, to extend outwardly from the member 18 and generally away from each other to beyond the opening 12.

If desired, a winch (not shown) or other device which provides a mechanical advantage can be attached to the member 18.

Industrial Applicability

A safety apparatus 16 as described above is particularly useful for anchoring workers who are performing repair and maintenance tasks in a manhole and for rescuing these workers from the manhole should this be necessary. Should such a worker fall into a pipe having fast moving water in it within the manhole, the anchoring means 32 prevents him from being carried along with the stream. Should the worker become unconscious through slipping and hitting his head, due to oxygen deficiency, due to toxic gases, or the like, he can be readily and rapidly rescued from the manhole 10 by a single person resting his feet upon the roughened surface 30 of the platform 26 and pulling upwardly upon the line 17.

The apparatus 16 just described has the advantages of being light and easy to transport and set up and being useful when the manhole opening 12 is on nonlevel ground. Also, the apparatus 16 allows a rescuer's strong leg muscles to be used during rescue operations. Thus, a single person can rescue a workman from the manhole 10.

Other aspects, objects and advantages of this invention can be obtained from a study of the drawings, the disclosure and the appended claims.

I claim:

1. In an enclosed chamber (10) having an overhead opening (12) having a periphery (14), an improved safety apparatus (16) for anchoring a line (17) attached to a person and for withdrawing the line (17) and the person from the chamber (10), comprising:

a generally planar member (18) generally centrally open and having a top portion (20) and a bottom portion (22), said member (18) being adapted to surroundingly engage a substantial portion of said periphery (14);

a support structure (26) attached to said member (18) adjacent said periphery (14);

anchoring means (32) for normally preventing a line (17) attached to a person in the chamber (10) from playing out downwardly into the chamber (10) and for allowing the line (17) to be freely drawn upwardly out of the chamber (10); and means (34) for mounting the anchoring means (32) to the member (18).

2. An apparatus as in claim 1, wherein said mounting means (34) includes a mounting structure (36) attached to a respective one of said support structure (26) and said anchoring means (32) and defining a generally vertically extending well (38) and a post (40) extending from a respective other of said support structure (26) and said anchoring means (32) and being adapted to generally fill said well (38).

3. An apparatus as in claim 2, wherein said member (18) is an incomplete ring (18) having a gap (24) therein generally on a diameter thereof which includes said respective one of said mounting structure (36) and said post (40) and removed generally maximally therefrom.

4. An apparatus (16) as in claim 3, including:

a construction (46) bridging said gap (24); and means (48) for adjusting the length of said construction (46).

5. An apparatus (16) as in claim 3, including:

a pair of generally downwardly extending rods (42,44) attached to said member (18), one adjacent each end of said gap (14).

6. An apparatus (16) as in claim 5, including:

a construction (46) attached between said rods (42,44) and bridging said gap (24); and means (48) for adjusting the length of said construction (46).

7. An apparatus (16) as in claim 3, further including:

a pair of ears (52,54) attached to said member (18) to extend outwardly passed said opening (12), said ears (52,54) extending generally away from each other.

8. An apparatus (16) as in claim 2, wherein said support structure (26) includes a platform (26) having a roughened upper surface (30).

9. An apparatus (16) as in claim 1, wherein said chamber (10) is a manhole, said periphery (14) is an infacing flange (14) upon which a cover normally sits, said support structure (26) includes a platform (26) extending across a part (28) of said member (18), and said mounting means (34) mounts said anchoring means (32) to said member (18) to extend generally above said platform (26).

* * * * *